US007614529B2

(12) United States Patent
Bolyard, Jr. et al.

(10) Patent No.: US 7,614,529 B2
(45) Date of Patent: Nov. 10, 2009

(54) SPOOL VALVE AND VALVE SEAT ASSEMBLY FOR AN INTERMITTENTLY OPERABLE HOT MELT ADHESIVE MATERIAL CONTROL MODULE

(75) Inventors: Edward W. Bolyard, Jr., Old Hickory, TN (US); Daniel D. Bourget, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 606 days.

(21) Appl. No.: 11/408,993

(22) Filed: Apr. 24, 2006

(65) Prior Publication Data

US 2007/0267450 A1 Nov. 22, 2007

(51) Int. Cl.
*B67D 3/00* (2006.01)

(52) U.S. Cl. ..... 222/504; 222/146.5; 222/509; 222/1; 137/625.65; 137/625.66; 137/625.69

(58) Field of Classification Search ..... 222/504, 222/509, 559, 146.2, 146.5, 1; 137/625.69, 137/625.65, 625.66

See application file for complete search history.

(56) References Cited

U.S. PATENT DOCUMENTS

| | | | | |
|---|---|---|---|---|
| 4,485,846 | A * | 12/1984 | Neff | 137/625.64 |
| 6,089,413 | A | 7/2000 | Riney et al. | |
| 6,171,089 | B1 | 1/2001 | Oehman, Jr. | |
| 6,422,428 | B1 | 7/2002 | Allen et al. | |
| 6,688,498 | B1 | 2/2004 | McGuffey | |
| 6,772,791 | B2 * | 8/2004 | Neff | 137/625.65 |
| 2002/0139818 | A1 * | 10/2002 | McGuffey | 222/571 |
| 2004/0099752 | A1 | 5/2004 | Boger | |

* cited by examiner

*Primary Examiner*—J. Casimer Jacyna
(74) *Attorney, Agent, or Firm*—Law Offices of Steven W. Weinrieb

(57) ABSTRACT

A spool valve and valve seat assembly disposed in the control module of a hot melt adhesive dispensing system is uniquely structured so as to effectively prevent fluid communication or "cross-talk" between a first dispensing outlet port and a second recirculation port, during those periods when the control module is effectively reciprocally cycling the spool valve between its oppositely disposed extreme conditions for alternatively permitting the hot melt adhesive material to be dispensed from the first outlet port or for re-routing the hot melt adhesive material through the recirculation passage so as to prevent the hot melt adhesive from being improperly dispensed as a result of being undesirably routed to the recirculation passage.

20 Claims, 2 Drawing Sheets

SPOOL VALVE AND VALVE SEAT ASSEMBLY FOR AN INTERMITTENTLY OPERABLE HOT MELT ADHESIVE MATERIAL CONTROL MODULE

FIELD OF THE INVENTION

The present invention relates generally to hot melt adhesive material dispensing systems, and more particularly to a new and improved spool valve and valve seat assembly which is disposed within the control module of a hot melt adhesive material dispensing system wherein the new and improved spool valve and valve seat assembly of the control module is uniquely structured so as to effectively prevent fluid communication or "cross-talk" between a first outlet port, leading to the hot melt adhesive material dispensing nozzle, and a second outlet port, leading to the hot melt adhesive material recirculation passage or circuit, during those periods when the control module is effectively reciprocally cycling the spool valve between its oppositely disposed extreme conditions for alternatively permitting the hot melt adhesive material to be dispensed from the first outlet port leading to the hot melt adhesive material dispensing nozzle, or for re-routing the hot melt adhesive material through the hot melt adhesive material recirculation passage or circuit so as to prevent the hot melt adhesive material from being improperly, undesirably, or incompletely dispensed from the first outlet port leading to the hot melt adhesive material dispensing nozzle as a result of being improperly or undesirably routed to the recirculation passage or circuit.

BACKGROUND OF THE INVENTION

Hot melt adhesive material metered dispensing systems must be operated intermittently in order to, for example, only deposit the hot melt adhesive material upon predetermined regions of substrates, at predetermined times, so as not to cause operational problems or to result in undesirable product characteristics, and concomitantly, to control the flow of the hot melt adhesive material during those periods of time when the hot melt adhesive material is not actually being dispensed. Control modules, having suitable valve mechanisms incorporated therein, are conventionally used to effectively control the starting and stopping of the flow of the hot melt adhesive material to the dispensing nozzle and its associated discharge orifice. In view of the fact that the metering pumps, for supplying the hot melt adhesive material to the control module, are typically operated in a continuous manner for achieving proper or desirable operational and control parameters, the hot melt adhesive material must therefore be effectively re-routed during those periods of time that the hot melt adhesive material is not actually being conducted to the dispensing nozzle and its discharge orifice. This has been conventionally achieved by means of the control module which is effectively provided with two outlet ports whereby the hot melt adhesive material can alternatively be delivered to the dispensing nozzle and its discharge orifice or to a recirculation passage or circuit. More particularly, the control module conventionally comprises a pair of poppet-type valves disposed internally thereof so as to in fact respectively control the flow of the hot melt adhesive material to the dispensing nozzle and its discharge orifice, or to the recirculation passage or circuit. The two poppet-type valves are usually mounted upon opposite ends of a single stem member, whereby the poppet-type valves and the single stem member effectively form a reciprocally movable spool valve, and accordingly, when the spool valve undergoes its reciprocal movement in a first one of its two opposite directions, a first one of the poppet valves will effectively OPEN a first outlet port leading to the dispensing nozzle and its discharge orifice, while the second one of the poppet valves will simultaneously begin to CLOSE the second outlet port leading to the recirculation passage or circuit, and alternatively, when the spool valve undergoes its reciprocal movement in a second one of its two opposite directions, the second one of the poppet valves will OPEN the second outlet port leading to the recirculation passage or circuit while the first one of the poppet valves will effectively begin to CLOSE the first outlet port leading to the dispensing nozzle and its discharge orifice.

While the aforenoted conventional spool valve structure enables the hot melt adhesive material dispensing system to effectively operate substantially satisfactorily, in reality, the structural design of the conventional spool valve lead to operational problems. More specifically, the spool valve requires a finite amount of time to undergo its reciprocal movements between its two oppositely disposed extreme positions at which, for example, the first one of the poppet valves effectively OPENS the first outlet port leading to the dispensing nozzle and its discharge orifice, while the second one of the poppet valves simultaneously begins to CLOSE the second outlet port leading to the recirculation passage or circuit, and alternatively, when the second one of the poppet valves OPENS the second outlet port leading to the recirculation passage or circuit while the first one of the poppet valves effectively begins to CLOSE the first outlet port leading to the dispensing nozzle and its discharge orifice. Accordingly, while the spool valve is effectively in motion, that is, while the spool valve is moving between its oppositely disposed extreme positions, both of the poppet valves are effectively removed from their respective valve seats whereby both the first and second outlet ports, respectively leading to the dispensing nozzle and its discharge orifice, and to the hot melt adhesive material recirculation passage or circuit, are at least partially OPEN and therefore effectively fluidically communicate or "cross-talk" with each other. Accordingly, still further, the desired or proper dispensing of the hot melt adhesive material is not always properly, accurately, or completely ensured or achieved.

A need therefore exists in the art for a new and improved spool valve and valve seat assembly, for use within a control module of a hot melt adhesive material dispensing system, wherein the new and improved spool valve and valve seat assembly of the control module will be structured so as to effectively prevent fluid communication or "cross-talk" between the first outlet port, leading to the hot melt adhesive material dispensing nozzle and its discharge port, and the second outlet port, leading to the hot melt adhesive material recirculation passage or circuit, during those periods when the control module is effectively reciprocally cycling the spool valve between its oppositely disposed extreme conditions for alternatively permitting the hot melt adhesive material to be dispensed from the first outlet port leading to the hot melt adhesive material dispensing nozzle and its discharge orifice, or for re-routing the hot melt adhesive material through the hot melt adhesive material recirculation passage or circuit so as to prevent the hot melt adhesive material from being dispensed from the first outlet port leading to the hot melt adhesive material dispensing nozzle and its discharge orifice.

SUMMARY OF THE INVENTION

The foregoing and other objectives are achieved in accordance with the teachings and principles of the present invention through the provision of a new and improved spool valve and valve seat assembly, for use within the control module of a hot melt adhesive material dispensing system, wherein the spool valve comprises a stem member, and a pair of poppet-type valves fixedly mounted upon the oppositely disposed end portions of the stem member, and wherein further, the poppet valves are adapted to cooperate with a pair of axially spaced valve seats formed upon a fixed annular valve seat member. A recessed portion, formed, for example, by means of a plurality of circumferentially spaced flats, is formed upon an axially central portion of the stem member while a pair of axially spaced shoulder portions are formed at opposite ends of the recessed portion of the stem member so as to be interposed between the recessed portion and the poppet valves, and to cooperate with a pair of axially spaced shoulder portions formed upon the annular valve seat member.

Accordingly, when the spool valve is being reciprocally moved from a first one of its two extreme positions, at which the first one of the poppet valves is disengaged from its valve seat such that the first outlet port, leading to the dispensing nozzle and its discharge orifice, is OPEN, while the second one of the poppet valves is disengaged from its valve seat such that the second outlet port leading to the recirculation passage or circuit is CLOSED, toward the second one of its two extreme positions at which the first one of the poppet valves will be engaged with its valve seat such that the first outlet port leading to the dispensing nozzle and its discharge orifice will be CLOSED, while the second one of the poppet valves will be disengaged from its valve seat such that the second outlet port leading to the recirculation circuit or passage will be OPEN, the shoulder portion of the spool valve, operatively associated with the second one of the poppet valves, will not be disengaged from the second shoulder portion of the valve seat member, even though the second poppet valve has already been disengaged from the second valve seat, prior to the engagement of the shoulder portion of the spool valve, operatively associated with the first one of the poppet valves, with the first shoulder portion of the valve seat member. In this manner, even though both poppet valves may be simultaneously disengaged from their respective valve seats, the engagement of at least one of the first and second shoulder portions of the spool valve with at least one of the first and second shoulder portions of the valve seat member effectively prevents fluidic communication or "cross-talk" between the first and second outlet ports respectively leading to the dispensing nozzle and its discharge orifice, and to the recirculation circuit or passage. Similar operating procedures of course occur when the spool valve is reciprocally moved in the opposite direction.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
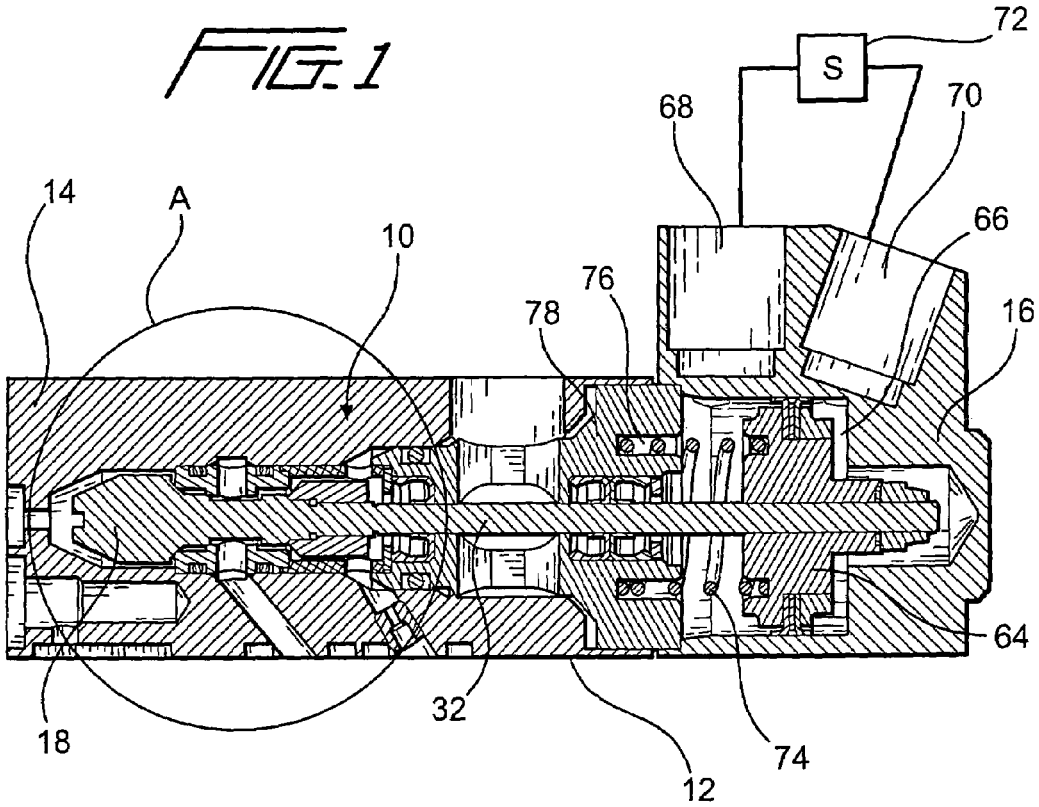
FIG. 1 is a cross-sectional view of a hot melt adhesive material control module having the new and improved spool valve and valve seat assembly, as constructed in accordance with the principles and teachings of the present invention, incorporated therein wherein the spool valve is disposed at a first one of its two oppositely disposed extreme positions at which a first one of its two oppositely disposed poppet valves is seated upon its valve seat so as to CLOSE the outlet port leading to the dispensing nozzle and its discharge orifice while a second one of its two oppositely disposed poppet valve is unseated from its valve seat so as to OPEN the outlet port leading to the recirculation circuit or passage.
Figure 2:
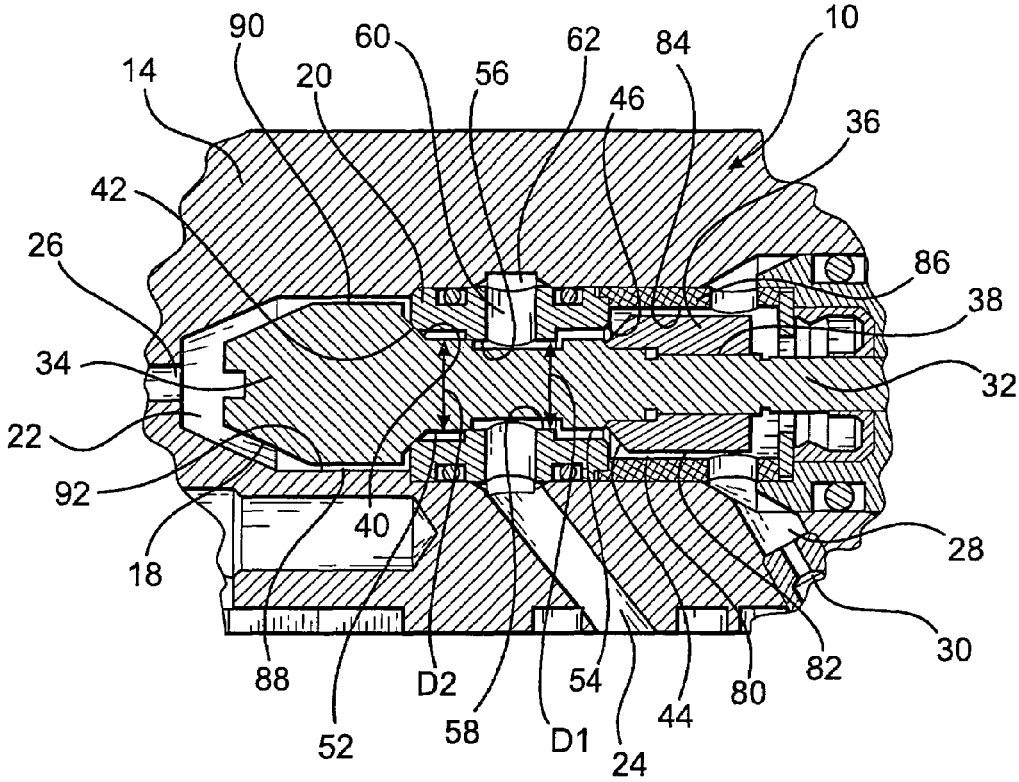
FIG. 2 is an enlarged detailed view of the encircled area A of FIG. 1 showing the details of the new and improved spool valve and valve seat assembly of the present invention as disclosed within FIG. 1.

Referring now to the drawings, and more particularly to FIGS. 1 and 2 thereof, the new and improved spool valve and valve seat assembly, as constructed in accordance with the principles and teachings of the present invention, is disclosed and is generally indicated by the reference character 10. The spool valve and valve seat assembly 10 is adapted to be used in connection with the dispensing of, for example, hot melt adhesive material, although it is of course to be noted that the spool valve and valve seat assembly 10 could be used in connection with the dispensing of other fluids, and it is seen that the spool valve and valve seat assembly 10 is disposed within a control module 12 which, in turn, is seen to comprise a spool valve and valve seat assembly housing 14 and an actuator piston housing 16. As can best be seen and appreciated from FIG. 2, the spool valve and valve seat assembly 10 is disposed within the spool valve and valve seat assembly housing 14 and comprises a reciprocally movable spool valve 18 and a fixed, annular valve seat member 20. The spool valve and valve seat assembly housing 14 is seen to comprise an internal bore 22 within which the spool valve and valve seat assembly 10 are disposed, and a hot melt adhesive material inlet or supply port 24 is defined within a substantially axially central side wall portion of the spool valve and valve seat assembly housing 14 so as to be in fluidic communication with the internal bore 22 as will become more fully appreciated hereinafter.

The spool valve and valve seat housing assembly housing 14 is also provided with a hot melt adhesive material dispensing outlet supply port 26, which is adapted to be in fluidic communication with the dispensing nozzle and its discharge orifice, not shown, and a hot melt adhesive material recirculation port or passage 28 which is adapted to be in fluidic communication with a supply reservoir and the metering pumps of an applicator, both not shown, which will return recirculated hot melt adhesive material back to the hot melt adhesive material inlet or supply port 24. A calibrated orifice 30 is fixedly disposed within the hot melt adhesive material recirculation port or passage 28 and is adapted to be fluidically matched to the discharge orifice disposed within the dispensing nozzle such that backpressure parameters or levels, prevailing within or characteristic of the hot melt adhesive material fluid flow within the hot melt adhesive material recirculation port or passage 28, effectively matches the supply pressure levels or parameters prevailing within or characteristic of the hot melt adhesive material fluid flow within the discharge passage defined within the dispensing nozzle. In this manner, pressure spikes within the system, which could result in the uneven or non-uniform dispensing of the hot melt adhesive material from the dispensing nozzle and its discharge orifice, not shown, are effectively prevented when the spool valve 18 is reciprocally moved between its two oppositely disposed positions in accordance with transitioning operations between the intermittent hot melt adhesive material dispensing and recirculation operational phases, as will become more apparent hereinafter.

It is lastly noted that while the hot melt adhesive material recirculation port or passage 28, and the calibrated orifice 30 fixedly disposed therein, are illustrated as being located upon the back side or face of the control module 12 which is adapted to be connected to or mounted upon the metering pump applicator, not shown, the hot melt adhesive material recirculation port or passage 28, and the calibrated orifice 30 fixedly disposed therein, can alternatively be located upon the front side or face of the control module 12 so as to be externally accessible to operator or maintenance personnel. In this manner, when the dispensing nozzle, and its discharge orifice, are changed so as to, for example, achieve different hot melt adhesive material deposition patterns, the calibrated orifice 30 can likewise be readily changed and replaced with a different calibrated orifice, matching the fluidic characteristics of the newly inserted dispensing nozzle and discharge orifice, without necessarily removing the control module 12 from the metering pump applicator.

Figure 4:
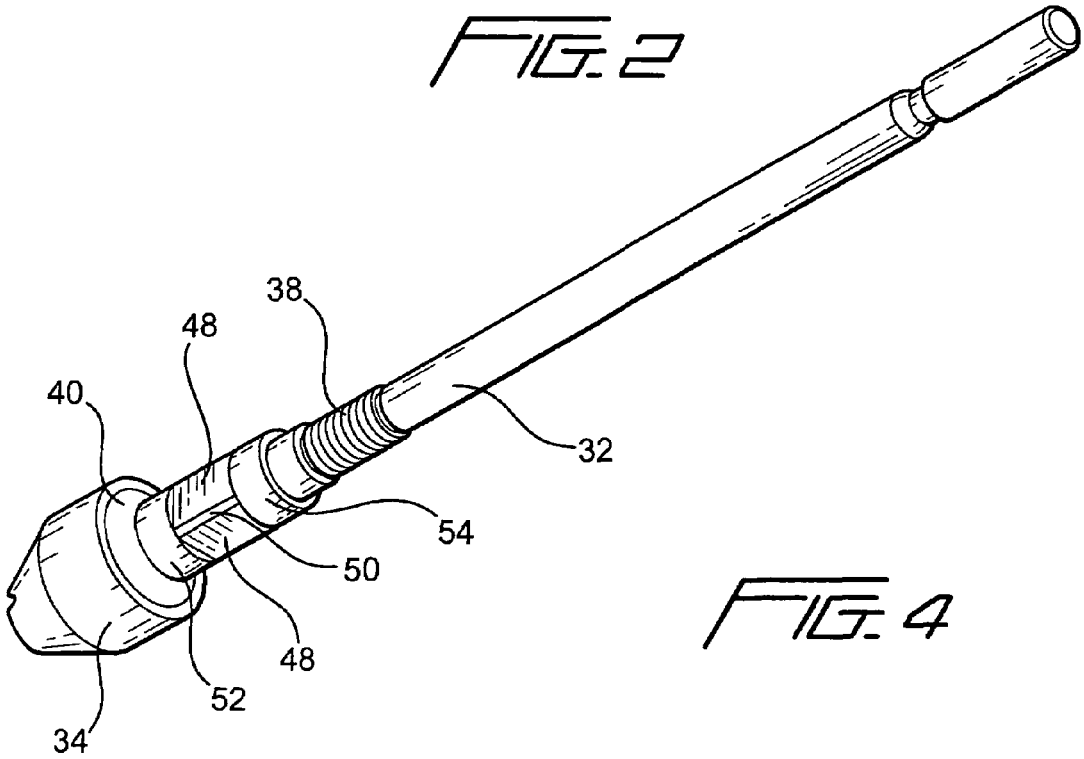
FIG. 4 is a perspective view of the spool valve stem member having only the first one of its two oppositely disposed poppet valves integrally formed thereon.

With reference continuing to be made to FIG. 2, and with additional reference being made to FIG. 4, it is seen that the spool valve 18 comprises a valve stem 32 having a first poppet-type valve 34 integrally formed upon a first end portion thereof while a second poppet-type valve 36 comprises, in effect, an annular poppet-type valve which is internally threaded so as to be threadedly engaged upon an externally threaded portion 38 of the valve stem 32. The first poppet valve 34 comprises a first annular poppet valve seat portion 40 at the upstream end portion thereof, as considered in the direction of the fluid flow of the hot melt adhesive material from the hot melt adhesive material inlet supply port 24 to the hot melt adhesive material outlet supply port 26, and the annular valve seat member 20 is correspondingly provided with a first annular valve seat portion 42 with respect to which the first annular poppet valve seat portion 40 is adapted to be seated or engaged so as to define a CLOSED state, or is adapted to be fully unseated or disengaged so as to define a fully OPEN state, depending upon whether or not the operative cycle is routing hot melt adhesive material to the hot melt adhesive material outlet supply port 26 or to the hot melt adhesive material recirculation passage or port 28. In a similar manner, the second poppet valve 36 comprises a second annular poppet valve seat portion 44 at the upstream end portion thereof, as considered in the direction of the fluid flow of the hot melt adhesive material from the hot melt adhesive material inlet supply port 24 to the hot melt adhesive material recirculation passage or port 28, and the annular valve seat member 20 is correspondingly provided with a second annular valve seat portion 46 with respect to which the second annular poppet valve seat portion 44 is adapted to be seated or engaged so as to define a CLOSED state, or is adapted to be fully unseated or disengaged so as to define a fully OPEN state, depending upon whether or not the operative cycle is routing hot melt adhesive material to the hot melt adhesive material outlet supply port 26 or to the hot melt adhesive material recirculation passage or port 28.

With reference continuing to be made to FIGS. 2 and 4, and in accordance with the principles and teachings of the present invention, it is further seen that the valve stem 32 is also provided with an annularly recessed region interposed between the first and second poppet valves 34, 36, and, more particularly, that the recessed region is defined by means of a plurality, such as, for example, four, of flat regions 48 which are equiangularly spaced from each other in the circumferential direction around the longitudinal axis of the valve stem 32 whereby each flat region 48 is effectively separated from an adjacent flat region 48 by means of a longitudinally extending rib portion 50. As a result of the definition or formation of the plurality of flat regions 48 upon the valve stem 32, a pair of axially spaced, radially outwardly projecting annular shoulder members 52, 54, as considered with respect to the longitudinal axis of the valve stem 32, are formed upon the valve stem 32 at axial positions disposed immediately adjacent to the plurality of flat regions 48. In a similar or corresponding manner, it is seen that the annular valve seat member 20 is likewise provided with a pair of axially spaced, radially inwardly projecting annular shoulder members 56,58, as considered with respect to the longitudinal axis of the valve stem 32, wherein the pair of axially spaced, radially inwardly projecting annular shoulder members 56,58 are formed upon the annular valve seat member 20 at axial positions which are located within the vicinity of the plurality of flat regions 48 as well as to be substantially interposed between the pair of axially spaced, radially outwardly projecting annular shoulder members 52, 54 of the valve stem 32 so as to structurally cooperate with the pair of axially spaced, radially outwardly projecting annular shoulder members 52, 54 of the valve stem 32 in a manner to become more apparent hereinafter.

In connection with the shoulder members 52, 54 of the valve stem 32, as well as in connection with the shoulder members 56, 58 of the annular valve seat member 20, it is to be appreciated that the internal diametrical extent D1 of each shoulder member 56, 58 of the annular valve seat member 20 is substantially the same as the external diametrical extent D2 of each shoulder member 52, 54 of the valve stem 32, wherein the external diameters D2 of the shoulder members 52, 54 of the valve stem 32 are just slightly less than the internal diameters D1 of the shoulder members 56, 58 of the annular valve seat member 20 so as to in fact permit the reciprocal movement of the valve stem 32 with respect to the annular valve seat member 20. Still further, it is also seen that in order to permit the incoming hot melt adhesive material, being supplied to the control module spool valve and valve seat assembly housing 14 by means of the hot melt adhesive inlet or supply port 24, to fluidically reach the internal bore 22 so as to, in turn, be permitted to be conducted either to the hot melt adhesive material outlet supply port 26 or to the hot melt adhesive material recirculation passage or port 28, depending upon the position of the spool valve 18 with respect to the annular valve seat member 20, the fixed, annular valve seat member 20 is further provided with a pair of mutually perpendicular or orthogonally disposed throughbores 60, only one of which is visible within FIGS. 1-3. In addition, the spool valve and valve seat assembly housing 14 is also provided with an annular passageway 62 which is disposed in fluidic communication with the pair of mutually perpendicular or orthogonally disposed through-bores 60 so as to provide fluidic communication thereto from the hot melt adhesive material inlet supply port 24.

Figure 3:
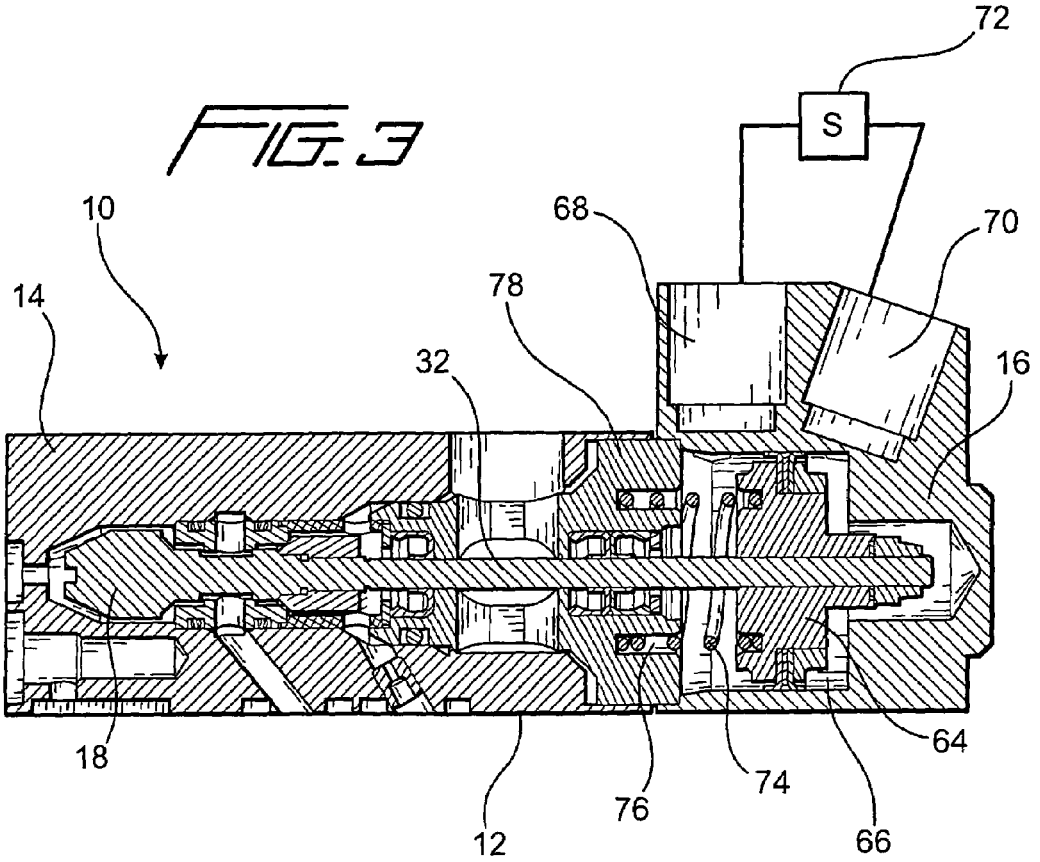
FIG. 3 is a cross-sectional view of the hot melt adhesive material control module, as disclosed within FIG. 1, showing, however, the spool valve disposed at a second one of its two oppositely disposed extreme positions at which the first one of its two oppositely disposed poppet valves is now unseated from its valve seat so as to OPEN the outlet port leading to the dispensing nozzle and its discharge orifice while the second one of its two oppositely disposed poppet valve is now seated upon its valve seat so as to CLOSE the outlet port leading to the recirculation circuit or passage.

Still yet further, as can best be appreciated from FIGS. 1 and 3, the right end portion of the valve stem 32, as viewed in FIGS. 1 and 3, is operatively connected to an actuator piston 64. The actuator piston 64 is adapted to be movably disposed within a piston chamber 66 of the actuator piston housing 16, and a pair of compressed air inlet ports 68, 70, alternatively connectable to a source of compressed air 72 through means of suitable valving, not shown, are fluidically connected to respective sections of the bored region 66 of the actuator piston housing 16 such that the air inlet pressures respectively act upon opposite side surface portions of the actuator piston 64. In this manner, the actuator piston 64, the valve stem 32, and the spool valve 18 can be reciprocally moved between their two, oppositely disposed extreme positions, as respectively disclosed within FIGS. 1 and 3, depending upon which one of the air inlet ports 68, 70 is fluidically connected to the source of air pressure 72.

It is noted that a coil spring 74 is coaxially mounted around the right end portion of the valve stem 32 such that the left end portion of the coil spring 74, as viewed in FIGS. 1 and 3, is disposed within an annular recessed portion 76 which is formed within a spring mounting member 78 that is fixedly mounted within the right end portion, as viewed in FIGS. 1 and 3, of the spool valve and valve seat assembly housing 14, while the right end portion of the coil spring 74 is disposed in contact with the left side surface portion of the actuator piston 64. In this manner, if, for some reason, the pneumatic system, providing the compressed air to the pair of air inlet ports 68, 70, should experience a failure, the actuator piston 64, the valve stem 32, and the spool valve 18 will normally be biased toward the right, as viewed in FIGS. 1 and 3, so that, as can best be appreciated from FIG. 2, the first annular poppet valve seat portion 40 of the first poppet valve 34 will be engaged with and seated upon the first annular valve seat portion 42 of the annular valve seat member 20 so that, in turn, conveyance of any hot melt adhesive material to the hot melt adhesive material outlet supply port 26 is terminated and further prevented.

Having described substantially all of the various intercooperating structural components comprising the new and improved spool valve and valve seat assembly 10, as constructed in accordance with the principles and teachings of the present invention, a brief operation of the new and improved spool valve and valve seat assembly 10 will now be described. As has been previously noted, and as can be appreciated from FIGS. 1 and 2, when the spool valve 18 is disposed at its extreme right position, the first annular poppet valve seat portion 40 of the first poppet valve 34 will be engaged with and seated upon the first annular valve seat portion 42 of the annular valve seat member 20 so that conveyance of the hot melt adhesive material to the hot melt adhesive material outlet supply port 26 is prevented, while simultaneously therewith, the second poppet valve seat portion 44 of the second poppet valve 36 will be fully disengaged or unseated from the second annular valve seat portion 46 of the annular valve seat member 20 so that conveyance of the hot melt adhesive material to the hot melt adhesive material recirculation port or passage 28 is permitted. In particular, the hot melt adhesive material flows into the control module through means of the hot melt adhesive inlet supply port 24, flows into the annular passageway 62 and the throughbores 60, and flows outwardly between the annular shoulder members 58, 54, respectively, of the annular valve seat member 20 and the valve stem 32, as well as between the second annular valve seat portion 46 of the annular valve seat member 20 and the second annular poppet valve seat portion 44 of the second poppet valve 36, in view of the fact that the second annular poppet valve seat portion 44 of the second poppet valve 36 is spaced from the second annular valve seat portion 46 of the annular valve seat member 20. The hot melt adhesive material is then able to finally flow into the hot melt adhesive material recirculation port or passage 28 after traversing a first annular passageway 80 which is effectively defined between the external peripheral surface portion 82 of the second poppet valve 36 and the internal peripheral surface portion 84 of an annular fixation member 86 which is disposed internally within the spool valve and valve seat assembly housing 14 so as to fixedly secure the annular valve seat member 20 within the spool valve and valve seat assembly housing 14.

Subsequently, when it is desired to effectively switch the disposition of the spool valve 18 from its first extreme position, as illustrated within FIGS. 1 and 2, to its second extreme position, as illustrated within FIG. 3, compressed air is admitted into the right air inlet port 70 so as to cause the actuator piston 64, and the valve stem 32, as well as the first and second poppet valves 34, 36, attached thereto, to move to the left so as to cause the first annular poppet valve seat portion 40 of the first poppet valve 34 to ultimately be fully disengaged or unseated from the first annular valve seat portion 42 of the annular valve seat member 20 so as to define the fully OPEN position of the first poppet valve 34 whereby hot melt adhesive material can be supplied to the hot melt adhesive material outlet supply port 26, while the second annular poppet valve seat portion 44 of the second poppet valve 36 is ultimately engaged with and seated upon the second annular valve seat portion 46 of the annular valve seat member 20 so as to define the CLOSED position of the second poppet valve 36 whereby re-routing of the hot melt adhesive material to the recirculation passage or circuit 28 is prevented. More particularly, when the spool valve 18 is disposed at this extreme position, the hot melt adhesive material will flow into the control module through means of the hot melt adhesive inlet supply port 24, will flow into the annular passageway 62 and the throughbores 60, and will flow outwardly between the annular shoulder members 56, 52, respectively, of the annular valve seat member 20 and the valve stem 32, as well as between the first annular valve seat portion 42 of the annular valve seat member 20 and the first annular poppet valve seat portion 40 of the first poppet valve 36, in view of the fact that the first annular poppet valve seat portion 40 of the first poppet valve 34 is now spaced from the first annular valve seat portion 42 of the annular valve seat member 20. The hot melt adhesive material is then able to finally flow out through the hot melt adhesive material outlet supply port 26 after traversing a second annular passageway 88 which is effectively defined between the external peripheral surface portion 90 of the first poppet valve 34 and the internal peripheral surface portion 92 of the spool valve and valve seat assembly housing 14. In connection with the first and second annular regions 80, 88, it is noted that they have substantially the same annular dimensions so as to ensure similar pressure values within or along the respective flow paths.

In light of the foregoing, it is of course appreciated that when the spool valve 18 is moved between its aforenoted first and second extreme positions, there will be time periods during which both the first and second annular poppet valve seat portions 40, 44 of the first and second poppet valves 34, 36 will effectively be simultaneously disengaged or unseated from their respective first and second annular valve seat portions 42, 46 of the annular valve seat member 20, such that the spaces defined therebetween are, in effect, partially OPEN, and therefore, fluidic communication or "cross-talk" could undesirably occur between the hot melt adhesive dispensing and recirculation flow paths which could adversely affect the hot melt adhesive material dispensing process and product integrity or quality. In accordance with the teaching and principles of the present invention, however, such undesirable fluidic communication or "cross-talk" is effectively eliminated or prevented.

More particularly, it is to be appreciated that when, for example, the spool valve 18 is to be shifted or moved to the left from its first extreme position illustrated within FIGS. 1 and 2, to its second extreme position illustrated within FIG. 3, it can be appreciated from FIG. 2 that as the first annular poppet valve seat portion 40 of the first poppet valve 34 becomes disengaged or unseated from the first annular valve seat portion 42 of the annular valve seat member 20, so as to effectively partially OPEN the space defined therebetween, the first shoulder portion 52 of the valve stem 32 will nevertheless be engaged with the first shoulder portion 56 of the annular valve seat member 20 and will continue to be so engaged with the first shoulder portion 56 of the annular valve seat member 20 until the valve spool 18 has been moved a sufficient axial distance to the left that permits the second shoulder portion 54 of the valve stem 32 to be engaged with the second shoulder portion 58 of the annular valve seat member 20. The reverse structural intercooperation of course occurs when the spool valve 18 is being moved from its second extreme position illustrated within FIG. 3 back to its first extreme position illustrated within FIGS. 1 and 2.

In other words, the fluid passageways, respectively leading from the hot melt adhesive inlet supply port 24 to the hot melt adhesive material outlet supply port 26, and from the hot melt adhesive inlet supply port 24 to the hot melt adhesive material recirculation passage or circuit 28, are never in communication with each other but are always fluidically blocked off or fluidically separated from each other by means of the aforenoted structural cooperation defined between the respective shoulder portions 52, 56 and 54, 58 of the valve stem 32 and the annular valve seat member 20. More particularly, the cooperating shoulder portions 52, 56 of the valve stem 32 and the annular valve seat member 20 will not permit hot melt adhesive material fluid flow to the hot melt adhesive material outlet supply port 26 until the cooperating shoulder portions 54, 58 of the valve stem 32 and the annular valve seat member 20 have completely blocked off the hot melt adhesive material fluid flow to the hot melt adhesive material recirculation passage or circuit 28, and conversely, the cooperating shoulder portions 54, 58 of the valve stem 32 and the annular valve seat member 20 will not permit hot melt adhesive material fluid flow to the hot melt adhesive material recirculation passage or circuit 28 until the cooperating shoulder portions 52, 56 of the valve stem 32 and the annular valve seat member 20 have completely blocked off the hot melt adhesive material fluid flow to the hot melt adhesive material outlet supply port 26. It is also to be appreciated that the longitudinally or axially extending rib portions 50 defined between successive ones of the flat regions 48 serve to effectively guide the central portion of the valve stem 32 within or through the valve seat member 20 while the spool valve 18 is being moved between its first and second extreme positions as illustrated within FIGS. 1 and 3.

Thus, it may be seen that in accordance with the principles and teachings of the present invention, there has been disclosed a new and improved spool valve and valve seat assembly which is disposed within the control module of a hot melt adhesive material dispensing system wherein the new and improved spool valve and valve seat assembly of the control module is uniquely structured so as to effectively prevent fluid communication or "cross-talk" between a first outlet port, leading to the hot melt adhesive material dispensing nozzle, and a second outlet port, leading to the hot melt adhesive material recirculation passage or circuit, during those periods when the control module is effectively reciprocally cycling the spool valve between its oppositely disposed extreme conditions for alternatively permitting the hot melt adhesive material to be dispensed from the first outlet port leading to the hot melt adhesive material dispensing nozzle, or for re-routing the hot melt adhesive material through the hot melt adhesive material recirculation passage or circuit so as to prevent the hot melt adhesive material from being improperly, undesirably, or incompletely dispensed from the first outlet port leading to the hot melt adhesive material dispensing nozzle as a result of being improperly or undesirably routed to the recirculation passage or circuit.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letters patent of the United States of America, is:

1. A spool valve and valve seat assembly for use within a fluid dispensing control module, comprising:

a spool valve having a longitudinal axis, first and second axially spaced valve seat portions defined upon said spool valve, and first and second axially spaced shoulder portions defined upon said spool valve adjacent to said first and second axially spaced valve seat portions;

a valve seat member having first and second axially spaced valve seat portions defined upon said valve seat member, and first and second axially spaced shoulder portions defined upon said valve seat member at substantially axially central portions of said valve seat member which are spaced axially remote from said first and second axially spaced valve seat portions of said valve seat member;

said spool valve being axially movable, with respect to said valve seat member, between first and second extreme positions, wherein said first valve seat portions of said spool valve and said valve seat member operatively cooperate together, as a result of said first valve seat portion of said spool valve being disposed at a first seated position upon said first valve seat portion of said valve seat member, when said spool valve is disposed at said first extreme position, so as to define a CLOSED position with respect to said first valve seat portion of said valve seat member and thereby prevent the flow of a fluid, through a first space defined between said first valve seat portions of said spool valve and said valve seat member, toward a first fluid passage, while second valve seat portions of said spool valve and said valve seat member operatively cooperate together, as a result of said second valve seat portion of said spool valve being disposed at a second fully unseated position with respect to said second valve seat portion of said valve seat member, when said spool valve is disposed at said first extreme position, so as to define a fully OPEN position with respect to said second valve seat portion of said valve seat member and thereby permit the flow of the fluid, through a second space defined between said second valve seat portions of said spool valve and said valve seat member, toward a second fluid passage, and wherein said first valve seat portions of said spool valve and said valve seat member operatively cooperate together, as a result of said first valve seat portion of said spool valve being disposed at a second unseated position with respect to said first valve seat portion of said valve seat member, when said spool valve is disposed at said second extreme position, so as to define an OPEN position with respect to said first valve seat portion of said value seat member and thereby permit the flow of the fluid, through said first space defined between said first value sear portions of said spool value and said valve seat member, toward said first fluid passage, while said second value seat portions of said spool value and said value seat member operatively cooperate together, as a result of said second valve seat portion of said spool valve being disposed at a seated position upon said second valve seat portion of said valve seat member, when said spool valve is disposed at said second extreme position, so as to define a CLOSED position with respect to said second valve seat portion of said valve seat member and thereby prevent the flow of the fluid, through said second space defined between said second valve seat portions of said spool valve and said valve seat member, toward said second fluid passage; and wherein said first and second axially spaced shoulder positions defined upon said valve seat member operatively cooperate in a slidably engaged manner with said first and second axially spaces shoulder portions of said spool valve, for prevention fluidic communication between said first and second fluid passages, even when both of said first and second valve seat portions of said spool valve are unseated from said first and second valve seat portions of said valve seat member as said spool valve is being axially moved in a transitional manner, relative to said valve seat member, between said first and second extreme positions.

2. The assembly as set forth in claim 1, wherein said first shoulder portions of said spool valve and said valve seat member will operatively cooperate together, as a result of said first shoulder portion of said spool valve being slidably engaged with said first shoulder portion of said valve seat member, even when said first valve seat portion of said spool valve has been unseated from said first valve seat portion of said valve seat member as a result of said spool member being moved from said first extreme position toward said second extreme position, so as to prevent the flow of fluid through said first space defined between said first valve seat portions of said spool valve and said valve seat member, until said second shoulder portions of said spool valve and said valve seat operatively cooperate together, as a result of said second shoulder portion of said spool valve being slidably engaged with said second shoulder portion of said valve seat member, as a result of said spool member being moved from said first extreme position toward said second extreme position, so as to prevent the flow of fluid through said second space defined between said second valve seat portions of said spool valve and said valve seat member despite the fact that second valve seat portion of said spool valve is still unseated from said second valve seat portion of said valve seat member.

3. The assembly as set forth in claim 2, wherein:

said spool valve comprises an axially oriented valve stem and first and second poppet valves fixedly mounted upon axially spaced portions of said valve stem; and said first and second axially spaced shoulder portions defined upon said spool valve are interposed between said first and second axially spaced poppet valves.

4. The assembly as set forth in claim 2, wherein:

said first and second axially spaced shoulder portions of said valve seat member are defined at substantially axially central portions of said valve seat member.

5. The assembly as set forth in claim 3, further comprising:

annular recess means, defined upon said valve stem at an axial position substantially centrally located between said first and second poppet valves, for defining said first and second axially spaced shoulder portions of said spool valve.

6. The assembly as set forth in claim 5, wherein:

said annular recess means comprises a plurality of equiangularly spaced flat regions disposed within a circumferential array around the longitudinal axis of said valve stem.

7. The assembly as set forth in claim 6, further comprising:

a plurality of axially extending rib members defined between successive ones of said plurality of equiangularly spaced flat regions of said valve stem for guidingly assisting the movement of said valve stem within said valve seat member as said spool valve is moved between said first and second extreme positions.

8. The assembly as set forth in claim 1, wherein:

said spool valve and valve seat assembly comprises an assembly for use in connection with the dispensing of hot melt adhesive material.

9. A control module assembly for dispensing a fluid, comprising:

a control module housing having a fluid inlet port, a fluid dispensing outlet port, and a fluid recirculation outlet port;

a spool valve having a longitudinal axis, first and second axially spaced valve seat portions defined upon said spool valve, and first and second axially spaced shoulder portions defined upon said spool valve adjacent to said first and second axially spaced valve seat portions;

a valve seat member having first and second axially spaced valve seat portions defined upon said valve seat member, and first and second axially spaced shoulder portions defined upon said valve seat member at substantially axially central portions of said valve seat member which are spaced axially remote from said first and second axially spaced valve seat portions of said valve seat member;

said spool valve being axially movable, with respect to said valve seat member, between first and second extreme positions, wherein said first valve seat portions of said spool valve and said valve seat member operatively cooperate together, as a result of said first valve seat portion of said spool valve being disposed at a first seated position upon said first valve seat portion of said valve seat member, when said spool valve is disposed at said first extreme position, so as to define a CLOSED position with respect to said first valve seat portion of said valve seat member and thereby prevent the flow of a fluid, through a first space defined between said first valve seat portions of said spool valve and said valve seat member, from said fluid inlet port toward said fluid dispensing outlet port, while second valve seat portions of said spool valve and said valve seat member operatively cooperate together, as a result of said second valve seat portion of said spool valve being disposed at a second fully unseated position with respect to said second valve seat portion of said valve seat member, when said spool valve is disposed at said first extreme position, so as to define a fully OPEN position with respect to said second valve seat portion of said valve seat member and thereby permit the flow of the fluid, through a second space defined between said second valve seat portions of said spool valve and said valve seat member, from said fluid inlet port toward said fluid recirculation outlet port, and wherein said first valve seat portions of said spool valve and said valve seat member operatively cooperate together, as a result of said first valve seat portion of said spool valve being disposed at a second unseated position with respect to said first valve seat portion of said valve seat member, when said spool valve is disposed at said second extreme position, so as to define an OPEN position with respect to said first valve seat portion of said valve seat member and thereby permit the flow of the fluid, through said first space defined between said first valve seat portions of said spool valve and said valve seat member, from said fluid inlet port toward said fluid dispensing outlet port, while said second valve seat portions of said spool valve and said valve seat member operatively cooperate together, as a result of said second valve seat portion of said spool valve being disposed at a seated position upon said second valve seat portion of said valve seat member, when said spool valve is disposed at said second extreme position, so as to define a CLOSED position with respect to said second valve seat portion of said valve seat member and thereby prevent the flow of the fluid, through said second space defined between said second valve seat portions of said spool valve and said valve seat member, from said fluid inlet port toward said fluid recirculation outlet port; and wherein said first and second axially spaced shoulder portions defined upon said valve seat member operatively cooperate in a slidably engaged manner with said first and second axially spaced shoulder portions of said spool valve, for preventing fluidic communication between said fluid dispensing outlet port and said fluid recirculation outlet port, even when both of said first and second valve seat portions of said spool valve are unseated from said first and second valve seat portions of said valve seat member as said spool valve is being axially moved in a transitional manner, relative to said valve seat member, between said first and second extreme positions.

10. The assembly as set forth in claim 9, wherein said first shoulder portions of said spool valve and said valve seat member will operatively cooperate together, as a result of said first shoulder portion of said spool valve being slidably engaged with said first shoulder portion of said valve seat member, even when said first valve seat portion of said spool valve has been unseated from said first valve seat portion of said valve seat member as a result of said spool member being moved from said first extreme position toward said second extreme position, so as to prevent the flow of fluid through said first space defined between said first valve seat portions of said spool valve and said valve seat member, until said second shoulder portions of said spool valve and said valve seat operatively cooperate together, as a result of said second shoulder portion of said spool valve being slidably engaged with said second shoulder portion of said valve seat member, in response to said spool member being moved from said first extreme position toward said second extreme position, so as to prevent the flow of fluid through said second space defined between said second valve seat portions of said spool valve and said valve seat member despite the fact that second valve seat portion of said spool valve is still unseated from said second valve seat portion of said valve seat member.

11. The assembly as set forth in claim 10, wherein:

said spool valve comprises an axially oriented valve stem and first and second poppet valves fixedly mounted upon axially spaced portions of said valve stem; and said first and second axially spaced shoulder portions defined upon said spool valve are interposed between said first and second axially spaced poppet valves.

12. The assembly as set forth in claim 10, wherein:

said first and second axially spaced shoulder portions of said valve seat member are defined at substantially axially central portions of said valve seat member.

13. The assembly as set forth in claim 11, further comprising:

annular recess means, defined upon said valve stem at an axial position substantially centrally located between said first and second poppet valves, for defining said first and second axially spaced shoulder portions of said spool valve.

14. The assembly as set forth in claim 13, wherein:

said annular recess means comprises a plurality of equiangularly spaced flat regions disposed within a circumferential array around the longitudinal axis of said valve stem.

15. The assembly as set forth in claim 14, further comprising:

a plurality of axially extending rib members defined between successive ones of said plurality of equiangularly spaced flat regions of said valve stem for guidingly assisting the movement of said valve stem within said valve seat member as said spool valve is moved between said first and second extreme positions.

16. The assembly as set forth in claim 11, further comprising:

a piston chamber defined within said control module housing;

an actuator piston fixedly mounted upon said valve stem and adapted to be movably disposed within said piston chamber; and means for moving said actuator piston in one of two opposite directions, within said piston chamber, so as to cause said spool valve to be moved toward either one of said first and second extreme positions.

17. The assembly as set forth in claim 16, wherein said means for moving said actuator piston comprises:

a pair of pneumatic inlet ports defined within said control module housing and fluidically connected to said piston chamber for admitting air into said piston chamber, upon opposite sides of said actuator piston, so as to cause said actuator piston to move in said one of two opposite directions.

18. The assembly as set forth in claim 16, further comprising:

a coil spring disposed within said piston chamber for normally biasing said actuator piston, said valve stem, and said spool valve toward one of said first and second extreme positions at which said first valve seat portion of said spool valve will be disposed at first seated position with respect to said first valve seat portion of said valve seat member such that fluid flow toward said fluid dispensing outlet port is not permitted.

19. The assembly as set forth in claim 9, wherein:

said control module assembly comprises an assembly for use in connection with the dispensing of hot melt adhesive material.

20. A method for conveying a fluid between two fluid passages such that undesirable fluidic communication between said two fluid passages is prevented, comprising the steps of:

providing a spool valve having a longitudinal axis, first and second axially spaced valve seat portions defined upon said spool valve, and first and second axially spaced shoulder portions defined upon said spool valve adjacent to said first and second axially spaced valve seat portions;

providing a valve seat member having first and second axially spaced valve seat portions defined upon said valve seat member, and first and second axially spaced shoulder portions defined upon said valve seat member at substantially axially central portions of said valve seat member which are spaced axially remote from said first and second axially spaced valve seat portions of said valve seat member;

movably mounting said spool valve axially with respect to said valve seat member, between first and second extreme positions, wherein said first valve seat portions of said spool valve and said valve seat member operatively cooperate together, as a result of said first valve seat portion of said spool valve being disposed at a first seated position upon said first valve seat portion of said valve seat member, when said spool valve is disposed at said first extreme position, so as to define a CLOSED position with respect to said first valve seat portion of said valve seat member and thereby prevent the flow of a fluid, through a first space defined between said first valve seat portions of said spool valve and said valve seat member, toward a first one of said two fluid passages, while second valve seat portions of said spool valve and said valve seat member operatively cooperate together, as a result of said second valve seat portion of said spool valve being disposed at a second fully unseated position with respect to said second valve seat portion of said valve seat member, when said spool valve is disposed at said first extreme position, so as to define a fully OPEN position with respect to said second valve seat portion of said valve seat member and thereby permit the flow of the fluid, through a second space defined between said second valve seat portions of said spool valve and said valve seat member, toward a second one of said two fluid passages, and wherein said first valve seat portions of said spool valve and said valve seat member operatively cooperate together, as a result of said first valve seat portion of said spool valve being disposed at a second unseated position with respect to said first valve seat portion of said valve seat member, when said spool valve is disposed at said second extreme position, so as to define an OPEN position with respect to said first valve seat portion of said valve seat member and thereby permit the flow of the fluid, through said first space defined between said first valve seat portions of said spool valve and said valve seat member, toward said first one of said two fluid passages, while said second valve seat portions of said spool valve and said valve seat member operatively cooperate together, as a result of said second valve seat portion of said spool valve being disposed at a seated position upon said second valve seat portion of said valve seat member, when said spool valve is disposed at said second extreme position, so as to define a CLOSED position with respect to said second valve seat portion of said valve seat member and thereby prevent the flow of the fluid, through said second space defined between said second valve seat portions of said spool valve and said valve seat member, toward said second one of said two fluid passages; and wherein said first and second axially spaced shoulder portions defined upon said valve seat member operatively cooperate in a slidably engaged manner with said first and second axially spaced shoulder portions of said spool valve, for preventing fluidic communication between said first and second fluid passages even when both of said first and second valve seat portions of said spool valve are unseated from said first and second valve seat portions of said valve seat member as said spool valve is being axially moved in a transitional manner, relative to said valve seat member, between said first and second extreme positions.

* * * * *

UNITED STATES PATENT AND TRADEMARK OFFICE

CERTIFICATE OF CORRECTION

PATENT NO. : 7,614,529 B2
APPLICATION NO. : 11/408993
DATED : November 10, 2009
INVENTOR(S) : Bolyard, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 806 days.

Signed and Sealed this

Nineteenth Day of October, 2010

David J. Kappos

David J. Kappos
*Director of the United States Patent and Trademark Office*